US005896947A

United States Patent [19]

Kumar

[11] Patent Number: 5,896,947

[45] Date of Patent: Apr. 27, 1999

[54] ON BOARD LUBRICATION SYSTEMS FOR LUBRICATING TOP OF RAIL FOR CARS AND RAIL GAGE SIDE/WHEEL FLANGE FOR LOCOMOTIVES

[75] Inventor: Sudhir Kumar, Darien, Ill.

[73] Assignee: Tranergy Corporation, Bensenville, Ill.

[21] Appl. No.: 08/870,047

[22] Filed: Jun. 5, 1997

[51] Int. Cl.[6] ..... B61K 3/02

[52] U.S. Cl. ..... 184/3.2; 184/6.4; 184/108

[58] Field of Search ..... 184/3.1, 3.2, 6.4, 184/108; 104/279; 198/500

[56] References Cited

U.S. PATENT DOCUMENTS

| | | | |
|---|---|---|---|
| 742,786 | 10/1903 | Green | 104/279 |
| 791,640 | 6/1905 | Miner | 184/3.2 |
| 2,724,458 | 11/1955 | Allard | 184/3.2 |
| 4,711,320 | 12/1987 | Dombrowski et al. | 184/3.2 |
| 4,930,600 | 6/1990 | Kumar et al. | 184/3.2 |
| 5,477,941 | 12/1995 | Kumar et al. | 184/3.2 |
| 5,687,814 | 11/1997 | Craig et al. | 184/3.2 |

*Primary Examiner*—Christopher Verdier
*Attorney, Agent, or Firm*—Dorn, McEachran, Jambor & Keating

[57] ABSTRACT

In railroad applications, a new method of simultaneously lubricating the rail gage side (RAGS) and wheel flanges ahead of a locomotive's tractive wheels and lubricating the top of the rail (TOR) behind the tractive wheels to reduce the resistance of the trailing cars and reduce the locomotive wheel flange wear. The method involves controlling both lubricating units with the same computer controller when a single locomotive is used and two controllers located in two different locomotives in the case of a locomotive consist. The rail gage side lubricant spray is applied on curves of 2 degrees or more only on the high rail. For the top of rail lubrication at the trailing end of the locomotive or locomotive consist this invention requires that the angle of the lubricant jet on the rail from the vertical be between 0 and 80 degrees from the vertical, with the angle increasing in the rear or trailing direction. It further requires that the lubricant jet be a solid jet without breaking into a spray cone.

8 Claims, 8 Drawing Sheets

ON BOARD LUBRICATION SYSTEMS FOR LUBRICATING TOP OF RAIL FOR CARS AND RAIL GAGE SIDE/WHEEL FLANGE FOR LOCOMOTIVES

BACKGROUND OF THE INVENTION

In U.S. Pat. Nos. 4,930,600 and 5,477,941 Kumar and Kumar have presented the state of the art in intelligent on-board rail/wheel lubrication systems for railroad use. Those comments continue to apply and the disclosures of the 4,930,600 and 5,477,941 patents are incorporated by reference herein. They showed a method in which one or two lubricants are applied to the rail by an applicator after the last axle of the last locomotive has passed. There are situations where the lubricants may be applied differently for better advantage. The present invention is a new method of achieving such an advantage for both top of rail (TOR) lubrication and rail gage side (RAGS) lubrication.

SUMMARY OF THE INVENTION

Application of a lubricant to the top of the rail and possibly in addition another lubricant to the gage side of the rail behind the last axle of the last locomotive serves the purpose well for reducing the friction and wear of the trailing car wheels. It does not, however, reduce the wear of the locomotive wheel flanges. The present invention addresses this issue. It also defines a better way of aiming the top of rail (TOR) lubricant jet. For a locomotive or a consist of locomotives that are always oriented in the same way, maximum benefit for wheel-rail wear of both the cars and the locomotives is provided by lubricating the gage side of the rail or wheel flanges on the high rail in the front and simultaneously lubricating the top of the two rails in the trailing end of the locomotive or the locomotive consist. Control of the RAGS lubricator as well as the TOR lubricator can be done by the same controller for one locomotive or two controllers located in different locomotives for the case of a locomotive consist. Thus, this invention uses a rail gage side lubricator for the high rail in the front end of a locomotive and a top of the rail lubricator (for one or both rails) for the rear end of a locomotive or locomotive consist. Lubrication at both ends will turn on if the locomotives are pulling in front of the train or in the middle of the train. Only the front applicators will turn on, however, if the locomotives are being used as pushers.

The rate of lubricant application to the top of the rails at the trailing end of the locomotive or consist is controlled with respect to train speed, track curvature, trailing tonnage of the train, lubricant temperature, direction of travel, status of brake application and, optionally, whether it is raining. The rate of lubricant application to the rail gage side (or, alternatively, the locomotive wheel flanges) in the front end is controlled with respect to train speed, track curvature, trailing tonnage of the train, lubricant temperature and high rail versus low rail.

The rail gage side (RAGS) applicator can apply lubricant to the rail gage side only if it is accurately aimed at the rail gage corner. To achieve this the present invention requires four characteristics of the RAGS lubricant spray: 1) The spray must be vertically adjustable with a bracket between 0 to 6 inches; 2) The lubricant spray width at the rail must be between 0 to 1½ inches; 3) The angle of spray in a vertical plane transverse to the track must be between 30 degrees and 75 degrees from the vertical; and 4) On a curve of 2 degrees or more spray may be made only on the high rail. On track with less than 2 degrees of curve the lubricant spray may be shut off or continued at a minimal rate depending on the preference of the railroad.

The TOR lubricant application at the trailing end of the locomotive or locomotive consist, also must be applied in a certain way so that nearly all the lubricant stays on the rail. This invention requires that for the TOR lubricant jet the angle of the jet in a vertical plane parallel to the rail must be between 0 degrees and 80 degrees from the vertical, with the angle increasing toward the rear or trailing direction. In other words, the TOR jet has no component in the forward direction.

The invention further requires that the TOR jet be a solid jet before impact to minimize wind effects on the lubricant application to the rail. By "solid jet" it is meant that the lubricant is applied in a continuous stream of liquid extending from the applicator nozzle to the rail. In other words, the lubricant jet should not be atomized or otherwise broken into a spray of individual droplets.

DETAILED DESCRIPTION OF THE INVENTION

The present invention is intended to be mounted at the front and rear ends of a locomotive or locomotive consist. The device at the front end lubricates the rail gage side and/or wheel flanges of the locomotive and the car wheels. The device at the rear end lubricates the top of both rails. The two devices may use same or different lubricants. The lubricant applied to the top of the rail is, however, one which is consumable. Both lubricants are nontoxic and environmentally safe. Application of both lubricants is controlled by the same microprocessor when the two application devices are installed on a single locomotive unit for use with trains that are pulled by a single locomotive. For a locomotive consist when the front and rear units are mounted in two different locomotives, separate microprocessors are used in the two locomotives.

The rate of lubricant application of the top of rail applicator in the rear is controlled with respect to train speed, track curvature, the trailing tonnage of the train, lubricant temperature, direction of travel and status of brake application. The rate of lubricant application to the rail gage side/wheel flange in the front is controlled with respect to train speed, track curvature, trailing tonnage of the train, lubricant temperature and high rail versus low rail.

Figure 1:
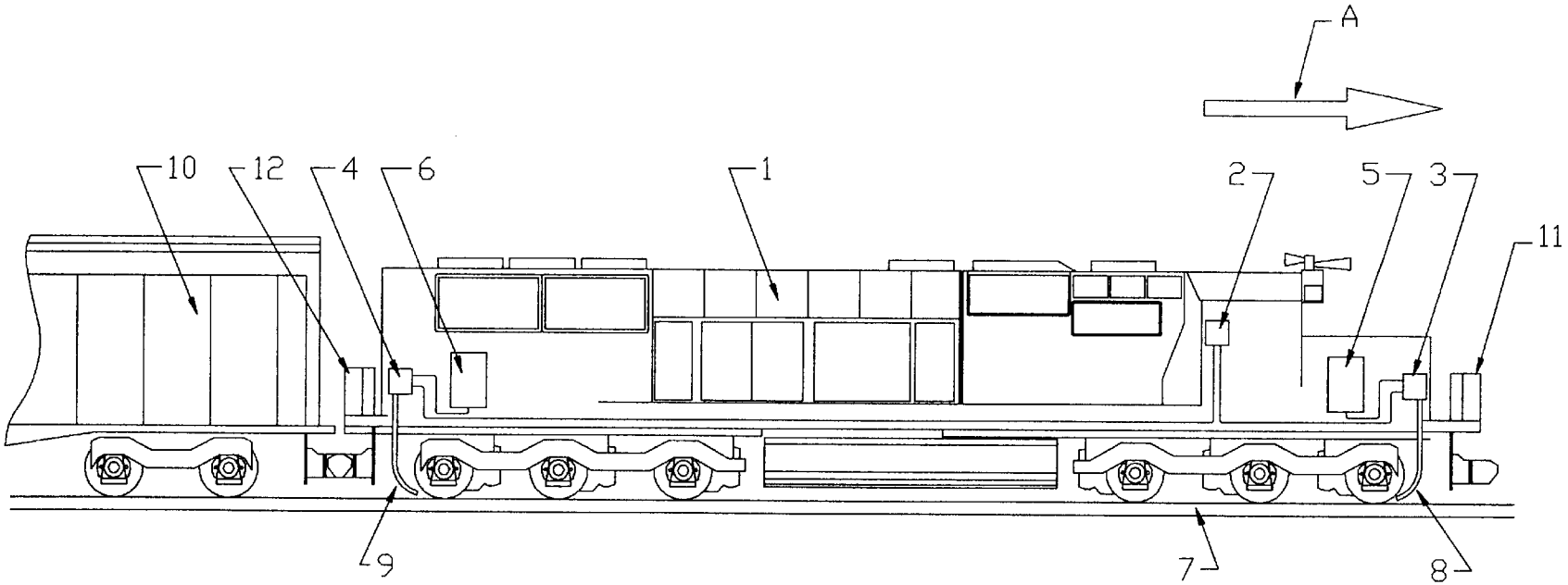
FIG. 1 is a side elevation view of a single locomotive pulling a train showing schematically both a RAGS lubricator at the front end and a TOR lubricator at the rear end, both lubricators being controlled by the same controller.

FIG. 1 shows a train 10 being pulled by a single locomotive 1 in the direction of arrow A. For trains that are not heavy, such as freight trains with less than 25 cars and passenger trains with half a dozen or so passenger cars, one locomotive provides quite adequate power. In such instances the locomotive is generally oriented with the short hood forward. For such applications, the present invention uses a rail gage side lubricator 8 at or near the forward or leading end 11 and a top of the rail lubricator 9 at or near the rear or trailing end 12 which, in the arrangement of FIG. 1, is the long hood end of the locomotive. Both units are controlled by the same controller 2. The two different lubricants used for the rail gage side and the top of rail application are kept under pressure in tanks 5 and 6. Hydraulic control units 3 and 4 get their control signals from the controlling computer processor 2 based on the current operating parameters. Based on these control signals the quantity of lubricant is applied by nozzles incorporated in applicator units 8 and 9. The application of lubricant in the front, short hood end 11 is done to the rail gage side or the wheel flange. It can be done in two different ways which are discussed later. The application of lubricant in the rear, long hood end 12 is done directly on top of the two rails.

Figure 2:
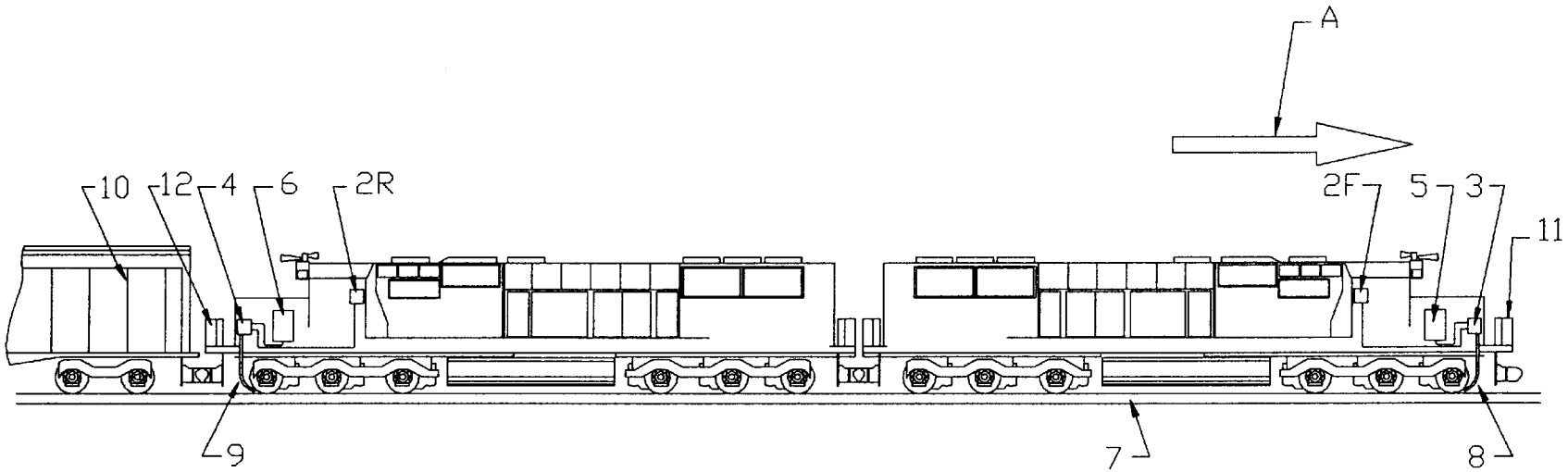
FIG. 2 is a side elevation view a locomotive consist with a RAGS lubricator mounted at the front end of the lead locomotive and a TOR lubricator located at the trailing end of the trailing locomotive.

FIG. 2 shows a consist of two locomotives coupled at their long hood ends. Many railroads are adopting a standard practice of using two locomotives coupled together in this fashion. The locomotive consist could have more than 2 locomotives. The rail gage side/wheel flange lubricator system 8 similar to the one located in FIG. 1 is located in the front end 11 moving forward in the direction of arrow A. This system uses its own independent controller 2F. On the trailing end 12 of the trailing locomotive a top of the rail lubricator system 9 similar to the one in FIG. 1 is located. It is controlled by its own independent controller 2R.

Figure 3:
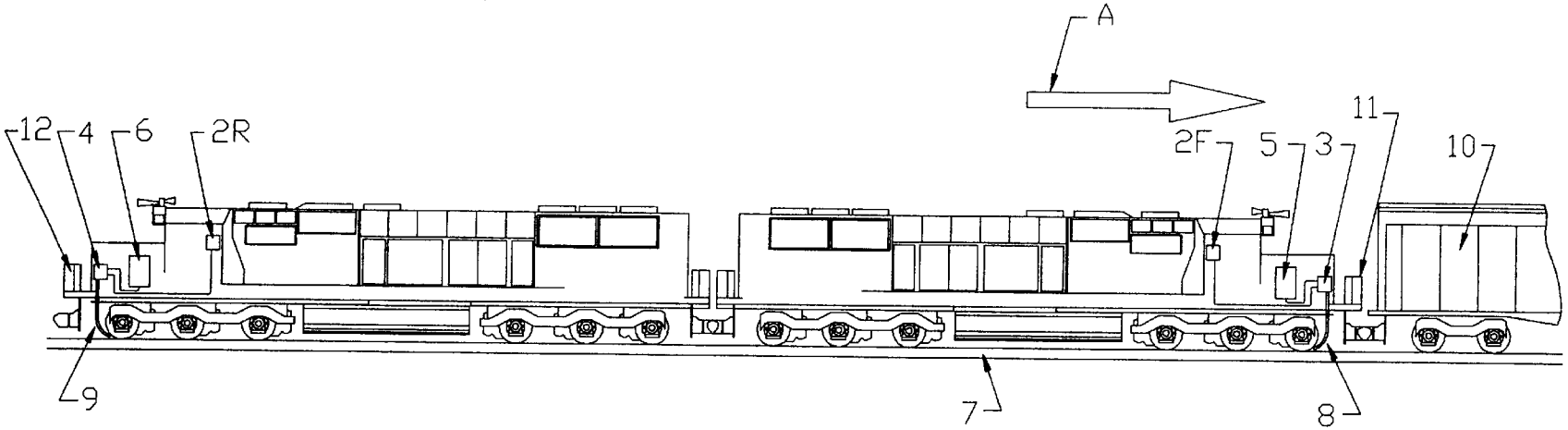
FIG. 3 is a side elevation view of a locomotive consist pushing a train from the rear with lubricator units located similarly as in FIG. 2.

FIG. 3 shows the application of a multiple locomotive consist, such as shown in FIG. 2, used as pusher locomotives to push the train in the direction of arrow A. In such an application only the rail gage side/wheel flange lubricator at front end 11 will turn on. The top of the rail lubricator at the trailing end 12 will remain shut off since there has to be a trailing tonnage above a certain specified amount for it to turn on and there is zero trailing tonnage behind end 12.

Figure 4:
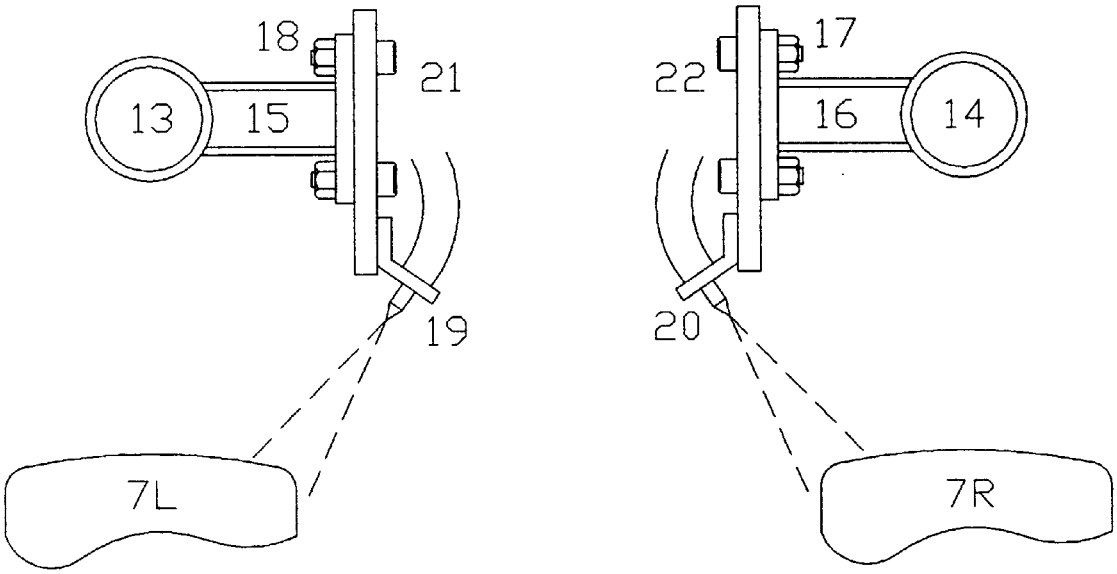
FIG. 4 is an end elevation view, looking longitudinally of the track, of the RAGS lubricator arrangement spraying lubricant at the gage corner of either or both rails.

FIG. 4 shows the arrangement of the lubricant applicator in the front of the locomotive or the locomotive consist. The lubricant nozzle and nozzle holders 19 and 20 are aimed at the gage sides of rails 7L and 7R between a 20 degrees and a 70 degrees angle from the vertical. They are attached to vertical plates 21, 22 with vertical slots so that the vertical position of nozzles 19 and 20 can be adjusted by several inches especially after the locomotive wheels are machined. Plates 21, 22 are attached structurally to a part of the truck near the axle. In FIG. 4 it is attached to the tube 13 and 14 of the sand nozzle holder through a beam or tube 15, 16. It is important that the nozzles 19, 20 are located close (between 4 inches to 24 inches) to the wheel-rail contact of the adjacent axle so that the lubricant spray hits the gage corner of the rail even on sharp curves.

Figure 5:
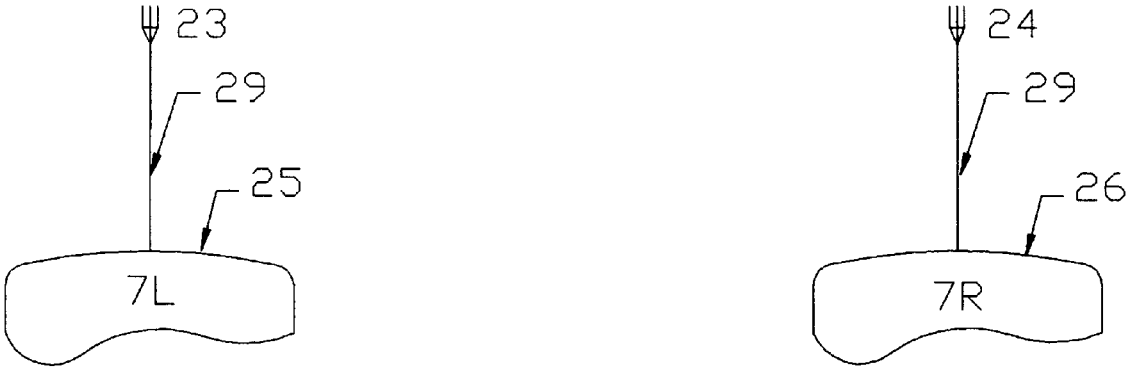
FIG. 5 is a schematic end elevation view at the rear end of a locomotive showing the TOR lubricant jet aimed at the center of the wheel-rail contact track.

FIG. 5 shows two nozzles 23, 24 which eject a jet 29 of top of rail lubricant on rails 7L and 7R. The nozzle holders are attached to the sand nozzle holder bracket and located at a height between 2 to 12 inches from the rail so that the lubricant jet contacts the rail between 2 to 30 inches from the wheel-rail contact. The nozzle holder 23 and 24 could also be attached to a plate or arm similar to 21 or 22 which is attached to the truck structure near the axle bearing so that it ejects the lubricant on the top of the rail aiming at the center of the wheel-rail contact track 25, 26 on the rail head. The nozzles 23, 24 do not atomize the lubricant. Rather a solid jet of lubricant has been found to best resist the tendency to be blown off the intended target.

Figure 6:
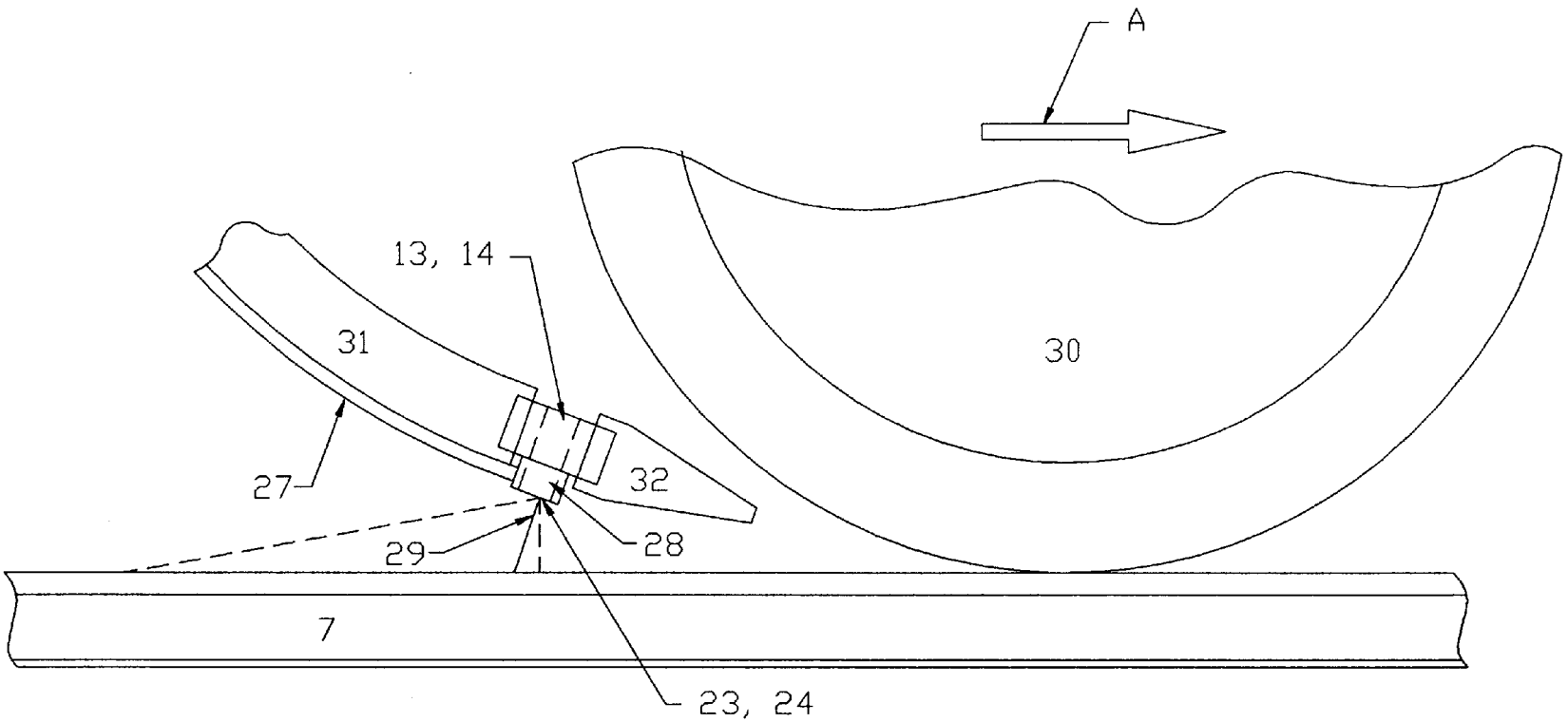
FIG. 6 is a side elevation view of the TOR lubricator.
Figure 7:
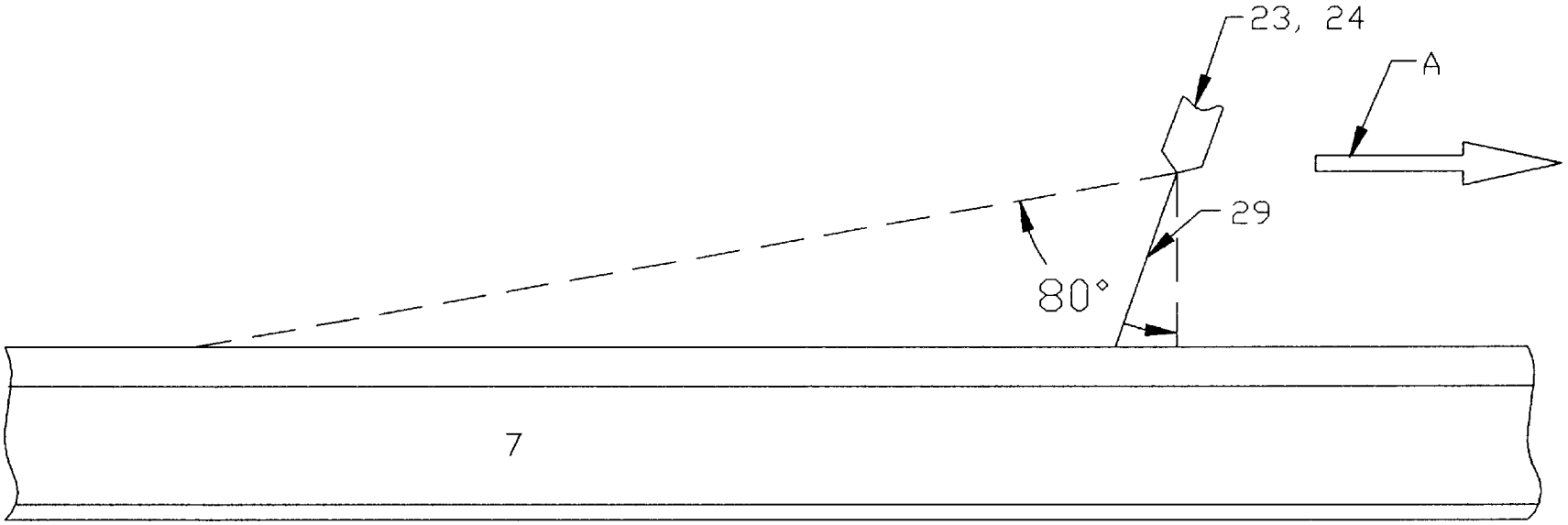
FIG. 7 is an enlarged view of the lubricator of FIG. 6, showing the application angle of the TOR lubricant jet at the rear end of the locomotive or locomotive consist.

FIGS. 6 and 7 show two side views of the lubricant nozzles directing a jet 29 of lubricant on top of the rail. The lubricant nozzle holder 28 and lubricant hose 27 are attached to the sand nozzle bracket 13 and the sand hose 31. The sand nozzle 32 is generally aimed at the wheel-rail contact. Sand application is activated when the locomotive is moving from right to left (opposite to the direction of arrow A). Top of rail lubricant application is activated only when the locomotive is moving in the direction of arrow A.

When the TOR lubricant is a thin low viscosity fluid, the lubricant jet tends to break up into a spray and be blown off the rail if the lubricant jet is aimed forwardly towards the wheel-rail contact (in FIGS. 6 and 7 arrow A points in the forward direction of travel). The present invention therefore, specifies that the lubricant jet 29 hit the rail between 0 degrees to 80 degrees from the vertical, with the angle increasing toward the trailing end of the locomotive, as shown in FIG. 7. Accordingly, the lubricant nozzle 23, 24 should be oriented between these angles. Preferably, the nozzle is nominally located directly above the rail, i.e., in the same vertical plane as the rail so there need be no transverse component in the TOR lubricant jet. With the nozzle disposed at the specified angle it always faces to the rear, or at most perpendicular to the direction of travel. It never faces forwardly. Accordingly, the top of the rail lubricant nozzle is never pointed into the wind generated by the locomotive's movement. Instead, the nozzle points either perpendicular to or with the wind, i.e., toward the rear. With this arrangement the lubricant jet will have a greatly reduced tendency to splash or spray off the rail after impacting the rail.

It is further specified that the lubricant jet be solid and not a spray. This is necessary in order to achieve the same goal of not breaking up the jet due to the wind that is produced during train movement.

Figure 8:
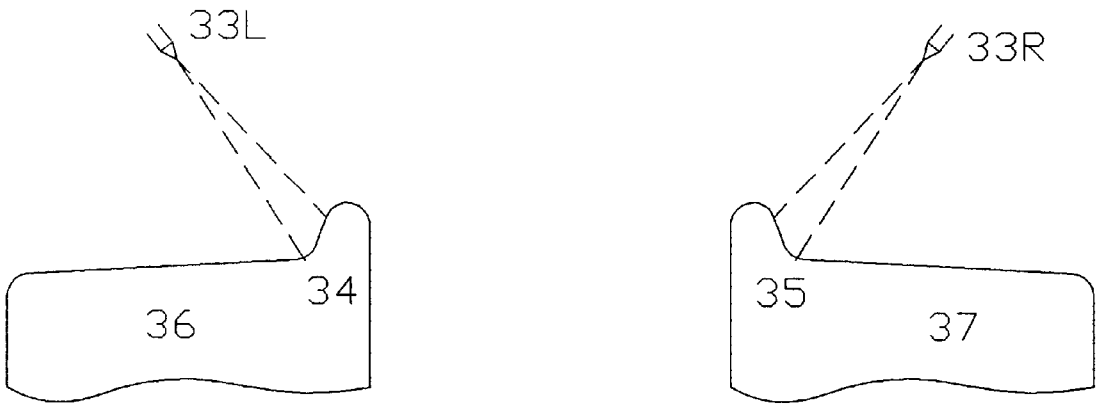
FIG. 8 shows an end elevation view of an alternate embodiment for applying a lubricant spray at the throat of the wheel flange and tread for the purpose of lubricating the rail gage side.

The above discussed arrangement for gage side lubrication in the front of the locomotive consist is the preferred arrangement. However, it does not preclude the application of the lubricant to the throat of the locomotive wheel flange 34, 35 as shown in FIG. 8, if a particular railroad prefers to do that. The lubricant nozzles 33L, 33R are therefore installed on a bracket attached to the truck structure such that the locomotive wheels 36, 37 are sprayed by the nozzles at the correct angle. The current wheel flange lubricators use this method. The wheel flange lubricators can be controlled by the same controller as the top of rail lubricators at the rear end of the locomotive.

While a preferred form of the invention has been shown and described, it will be realized that alterations and modifications may be made thereto without departing from the scope of the following claims.

I claim:

1. In a railroad locomotive having first and last tractive axles and operable on rails having a top and a gage side, an on-board lubricator mounted on the locomotive for applying a lubricant to the top of a rail behind the last tractive axle of the locomotive, said on-board lubricator comprising at least one lubricant supply tank, a hose connected to the lubricant supply tank and providing fluid communication to a nozzle which is mounted for directing a jet of lubricant onto the top of the rail behind the last tractive axle of the locomotive, means for controlling the flow of lubricant from the supply tank to the nozzle, the nozzle being mounted such that the jet of lubricant is disposed at an angle of between 0 degrees and 80 degrees to the vertical, with the angle increasing in the direction opposite to the direction of locomotive travel.

2. The on-board lubricator of claim 1 further characterized in that the nozzle directs a solid jet of lubricant onto the rail.

3. In a railroad locomotive having first and last tractive axles and operable on rails having a top and a gage side, an on-board lubricator mounted on the railroad locomotive for applying a lubricant to the top of a rail behind the last tractive axle of the locomotive, said on-board lubricator comprising at least one lubricant supply tank, a hose connected to the lubricant supply tank and providing fluid communication to a nozzle which is mounted above the rail for directing a jet of lubricant onto the top of the rail behind the last tractive axle of the locomotive, means for controlling the flow of lubricant from the supply tank to the nozzle, the nozzle being mounted such that the jet of lubricant is disposed in a vertical plane parallel to the rail and at an angle to the vertical that has no component in the same direction as the direction of locomotive travel.

4. The on-board lubricator of claim 3 further characterized in that the nozzle directs a solid jet of lubricant onto the rail.

5. In an on-board lubricator mounted on a railroad locomotive of the type having first and last tractive axles and operable on rails having a top and a gage side, a method for applying a lubricant to the top of a rail behind the last tractive axle of the locomotive, comprising the step of directing a jet of lubricant to the top of the rail behind the last tractive axle of the locomotive with the jet being in a vertical plane parallel to the rail and at an angle to the vertical that has no component in the same direction as the direction of locomotive travel.

6. In a railroad locomotive having first and last tractive axles and operable on left and right rails each having a top and a gage side, an on-board lubricating system mounted on a railroad locomotive for applying a lubricant to the rail gage side ahead of the first tractive axle of the locomotive, said on-board lubricating system comprising a lubricant supply tank, a pair of hoses connected to the lubricant supply tank and providing fluid communication to first and second nozzles which are mounted for directing a jet of lubricant onto the gage side of the left and right rails, respectively, means for measuring the degree of curvature of the rails, and a controller for governing the flow of the lubricant from the supply tank to the nozzles, the controller being responsive to the means for measuring the degree of curvature of the rails such that in curves of 2 degrees or more lubricant is sprayed only onto the high rail of the curve.

7. In an on-board lubricating system mounted on a railroad locomotive having first and last tractive axles and operable on left and right rails each having a top and a gage side, a method for applying a lubricant to the rail gage side ahead of the first tractive axle of the locomotive, comprising the steps of measuring the degree of curvature of the rails, and when the degree of curvature is 2 degrees or more, spraying lubricant onto the high rail of the curve while applying no lubricant to the low rail.

8. The method of claim 7 further comprising the steps of applying lubricant at a first rate to the rail gage side of both rails on tangent track and applying lubricant onto the high rail at a second rate that is higher than said first rate.

* * * * *